US007540631B2

(12) United States Patent
Watanabe et al.

(10) Patent No.: US 7,540,631 B2
(45) **Date of Patent: *Jun. 2, 2009**

(54) LED INDICATOR LAMP

(75) Inventors: Kazunori Watanabe, Anan (JP); Masaru Kato, Anan (JP)

(73) Assignee: Nichia Corporation, Anan-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/711,755

(22) Filed: Feb. 28, 2007

(65) Prior Publication Data

US 2007/0171642 A1 Jul. 26, 2007

Related U.S. Application Data

(62) Division of application No. 11/167,104, filed on Jun. 28, 2005, now Pat. No. 7,204,610, which is a division of application No. 10/257,035, filed as application No. PCT/JP01/00942 on Feb. 9, 2001, now Pat. No. 6,929,384.

(51) Int. Cl.
*F21V 5/00* (2006.01)

(52) U.S. Cl. ..... 362/252; 362/244; 362/246

(58) Field of Classification Search ..... 362/227, 362/235, 249, 252, 800, 237, 244, 246
See application file for complete search history.

(56) References Cited

U.S. PATENT DOCUMENTS 4,951,179 A * 8/1990 Machida ..... 362/522
5,055,855 A 10/1991 Nishio
5,144,117 A 9/1992 Hasegawa et al.
5,504,514 A 4/1996 Nelson
5,745,296 A 4/1998 Nakamura et al.
5,913,087 A 6/1999 Hirai
5,947,587 A 9/1999 Keuper et al.
5,954,424 A * 9/1999 Anderson et al. ..... 362/242
5,997,150 A 12/1999 Anderson
6,019,493 A 2/2000 Kuo et al.
6,102,552 A 8/2000 Tullis
6,191,872 B1 2/2001 DeCaro et al.
6,396,565 B1 5/2002 Yamamoto et al.
6,932,599 B1 * 8/2005 Hartung ..... 433/29

FOREIGN PATENT DOCUMENTS

JP 02287113 11/1990
JP 7-291129 11/1995
JP 10-21710 1/1998
JP 2000-502500 2/2000
WO 98/16777 4/1998
WO 00/49332 A1 8/2000

* cited by examiner

*Primary Examiner*—Thomas M Sember
(74) *Attorney, Agent, or Firm*—Wenderoth, Lind & Ponack, L.L.P.

(57) ABSTRACT

An LED indication lamp has desired luminous intensity distribution characteristics without need for any light-emitting diode of a special shape. The LED indication lamp comprising a plurality of light-emitting diodes and having specified luminous intensity distribution characteristics is further provided with a condenser lens. The light-emitting diodes are arranged in a pattern corresponding to a luminous intensity distribution pattern determined according to the luminous intensity distribution characteristics. The light-emitting diodes thus arranged and the condenser lens are arranged so that light emitted from the light-emitting diodes in the luminous intensity distribution pattern through the condenser lens satisfies the luminous intensity distribution characteristics.

2 Claims, 12 Drawing Sheets

LED INDICATOR LAMP

This application is a divisional of U.S. Ser. No. 11/167,104, filed Jun. 28, 2005, now U.S. Pat. No. 7,204,610, which is a divisional of U.S. Ser. No. 10/257,035, filed Oct. 8, 2002, now U.S. Pat. No. 6,929,384, which is a National Stage application of PCT/JP01/00942, filed Feb. 9, 2001.

BACKGROUND OF THE INVENTION

1. Field of the Invention

The present invention relates to an LED indicator lamp, particularly to an LED indicator lamp used in traffic signals.

2. Description of the Related Art

As light emitting diodes capable of emitting light of R, G and B primary colors, and light emitting diodes capable of emitting white light with high luminance, have been developed, LED indicator lamps constituted from a plurality of light emitting diodes arranged in an array have been put in use for various applications. An LED indicator lamp has a far higher service life than that of an incandescent lamp, and also shows a high efficiency and a high resistance against vibration. For these advantages, the LED indicator lamp has been used in advertising sign boards, traffic sign boards displaying route guide or traffic information, light source for traffic signals and large screens.

With regard to an application for traffic signals, in particular, while the incandescent lamp used as a light source of a conventional traffic signal requires large reflector mirrors and color filters, the LED indicator lamp has such advantages as a capability to emit light of a single color that eliminates a need for a color filter, and a capability to emit light with some degree of directivity that eliminates a need to install a large reflector mirror.

Moreover, a traffic signal constituted from LEDs that does not need reflector mirrors and color filters also has an advantage of being free from spurious lighting, that is otherwise caused by extraneous light that has entered a traffic light, is reflected from a reflector mirror placed behind an incandescent lamp and comes out of the traffic signal through a color filter.

A constitution of a traffic signal using light emitting diodes is disclosed in U.S. Pat. No. 6,019,493, wherein a high efficiency light emitting element capable of uniform light emission is constituted by providing a lens made by integrally forming a central convex lens and a plurality of annular convex lenses located around the central convex lens.

International Patent Application PCT/IB97/01974 (International Publication No. WO98/16777) discloses an LED indicator lamp that has a convex lens (Fresnel lens) placed in front thereof, and a plurality of light emitting diodes distributed densely around the optical axis of the lens so that failure of one of the light emitting diodes does not cause significant change in a light intensity distribution.

An LED indicator lamp used in traffic signals and sign boards is usually installed at overhead height so as to be recognized by many people from a distance. As such, the LED indicator lamp is required to emit light with horizontally symmetrical intensity distribution but asymmetrical intensity distribution in a vertical direction so that light intensity is higher in a front field and lower field.

As it has been made possible to increase luminous intensity of light emitting diodes recently, it is enabled to decrease a number of light emitting diodes required in an LED indicator lamp.

However, a new problem has arisen in that it is difficult to achieve planar light emission of uniform intensity with an LED indicator lamp consisting of a small number of light emitting diodes that have high luminous intensity.

SUMMARY OF THE INVENTION

An object of the present invention is to provide an LED indicator lamp that is capable of achieving planar light emission of uniform intensity and a desired luminous intensity distribution characteristic.

In order to achieve the object described above, a first LED indicator lamp of the present invention has a predetermined luminous intensity distribution characteristic and comprises a plurality of light emitting diodes and a condenser lens, wherein the light emitting diodes are arranged in a pattern that corresponds to a luminous intensity distribution pattern that is set according to the luminous intensity distribution characteristic described above, while the light emitting diodes and the condenser lens are arranged so that the luminous intensity distribution characteristic is achieved by light that is emitted by the plurality of light emitting diodes and output through the condenser lens in the luminous intensity distribution pattern.

The first LED indicator lamp of the present invention that is constituted as described above can achieve planar light emission of uniform intensity, since light emitted by the plurality of light emitting diodes is viewed through the condenser lens.

With the constitution described above, a desired luminous intensity distribution pattern can be easily formed since the luminous intensity distribution pattern is determined by a combination of an arrangement pattern of the light emitting diodes and relative positions of the light emitting diodes and the condenser lens.

In this specification, the term luminous intensity distribution characteristic is used in a broader sense than luminous intensity distribution pattern and includes luminous intensity distribution pattern.

Luminous intensity distribution pattern determined according to luminous intensity distribution characteristic means, for example, a luminous intensity distribution pattern that is suitable for achieving the luminous intensity distribution characteristic and, in case the luminous intensity distribution characteristic is represented by a particular luminous intensity distribution pattern, means the luminous intensity distribution pattern itself.

Moreover, an arrangement pattern that corresponds to a luminous intensity distribution pattern means an arrangement pattern that, in combination with one or more other elements, can achieve the luminous intensity distribution pattern.

In the first LED indicator lamp of the present invention, the plurality of light emitting diodes are preferably located at the focal point of the condenser lens or in the vicinity thereof.

Also in the first LED indicator lamp of the present invention, the plurality of light emitting diodes may be arranged in a plane that crosses the optical axis of the condenser lens at a right angle at the focal point of the condenser lens or in the vicinity thereof.

Also in the first LED indicator lamp of the present invention, the plurality of light emitting diodes may be arranged in a plane that crosses the optical axis of the condenser lens obliquely at the focal point of the condenser lens or in the vicinity thereof.

Such a constitution as described above makes it possible to change a luminous intensity distribution pattern in accordance with an angle between the plane and the optical axis.

Also in the first LED indicator lamp of the present invention, the plurality of light emitting diodes may be distributed in a three-dimensional arrangement at the focal point of the condenser lens or in the vicinity thereof.

This constitution makes it possible to form a luminous intensity distribution pattern in accordance with the three-dimensional arrangement of the light emitting diodes.

In the first LED indicator lamp of the present invention, the condenser lens is preferably a Fresnel lens that can be made thin and light in weight.

Also in the first LED indicator lamp of the present invention, the plurality of light emitting diodes may be disposed in such an arrangement wherein a number of light emitting diodes located above the optical axis of the condenser lens is larger than a number of light emitting diodes located below the optical axis, which enables light to be directed with higher intensity downwardly than upwardly.

In this specification, the words "up" and "down" refer to upper and lower positions, respectively, in a setup where an LED indicator lamp is used.

Also in the first LED indicator lamp of the present invention, the light emitting diodes may be disposed in such an arrangement wherein the light emitting diodes are distributed in one portion with a density different from that in other portions.

This constitution makes it possible to change light intensity depending on a direction through varying density of the light emitting diodes.

Furthermore, in the first LED indicator lamp of the present invention, the light emitting diodes may include light emitting diodes that are intended to correct unevenness in a light intensity distribution of a luminous intensity distribution pattern produced by light emitted through the condenser lens.

Also in the first LED indicator lamp of the present invention, the light emitting diodes may be disposed in such an arrangement wherein light emitting diodes are placed in at least one portion at intervals different from intervals between light emitting diodes in another portion.

This constitution makes it possible to change a light intensity distribution in a luminous intensity distribution pattern through varying intervals between the light emitting diodes.

The first LED indicator lamp of the present invention may also have a translucent cover placed in front of the condenser lens.

The translucent cover preferably has a lens pattern formed thereon so as to smooth out a periodic intensity distribution generated by a periodic arrangement of light emitting diodes.

A second LED indicator lamp of the present invention has a predetermined luminous intensity distribution characteristic and comprises a plurality of light emitting diodes, a condenser lens placed in front of the plurality of light emitting diodes and a translucent cover with a lens pattern formed thereon being placed in front of the condenser lens, wherein the light emitting diodes are arranged in a pattern that corresponds to a luminous intensity distribution pattern that is set according to the luminous intensity distribution characteristic described above, while the light emitting diodes, the condenser lens and the translucent cover are arranged so that the luminous intensity distribution characteristic is achieved by light that is emitted by the plurality of light emitting diodes through the condenser lens and the translucent cover in the luminous intensity distribution pattern.

The second LED indicator lamp of the present invention that is constituted as described above can achieve a luminous intensity distribution characteristic by virtue of the translucent cover in addition to the light emitting diodes and the condenser lens, and therefore makes it possible to form a luminous intensity distribution pattern that is difficult to form with only the light emitting diodes and the condenser lens, thereby satisfying broader requirements.

In the second LED indicator lamp of the present invention, a lens pattern formed on the translucent cover is preferably formed so as to smooth out a periodic intensity distribution generated by a periodic arrangement of light emitting diodes, and makes luminance uniform over a light emitting plane.

DESCRIPTION OF THE PREFERRED EMBODIMENTS

Figure 1:
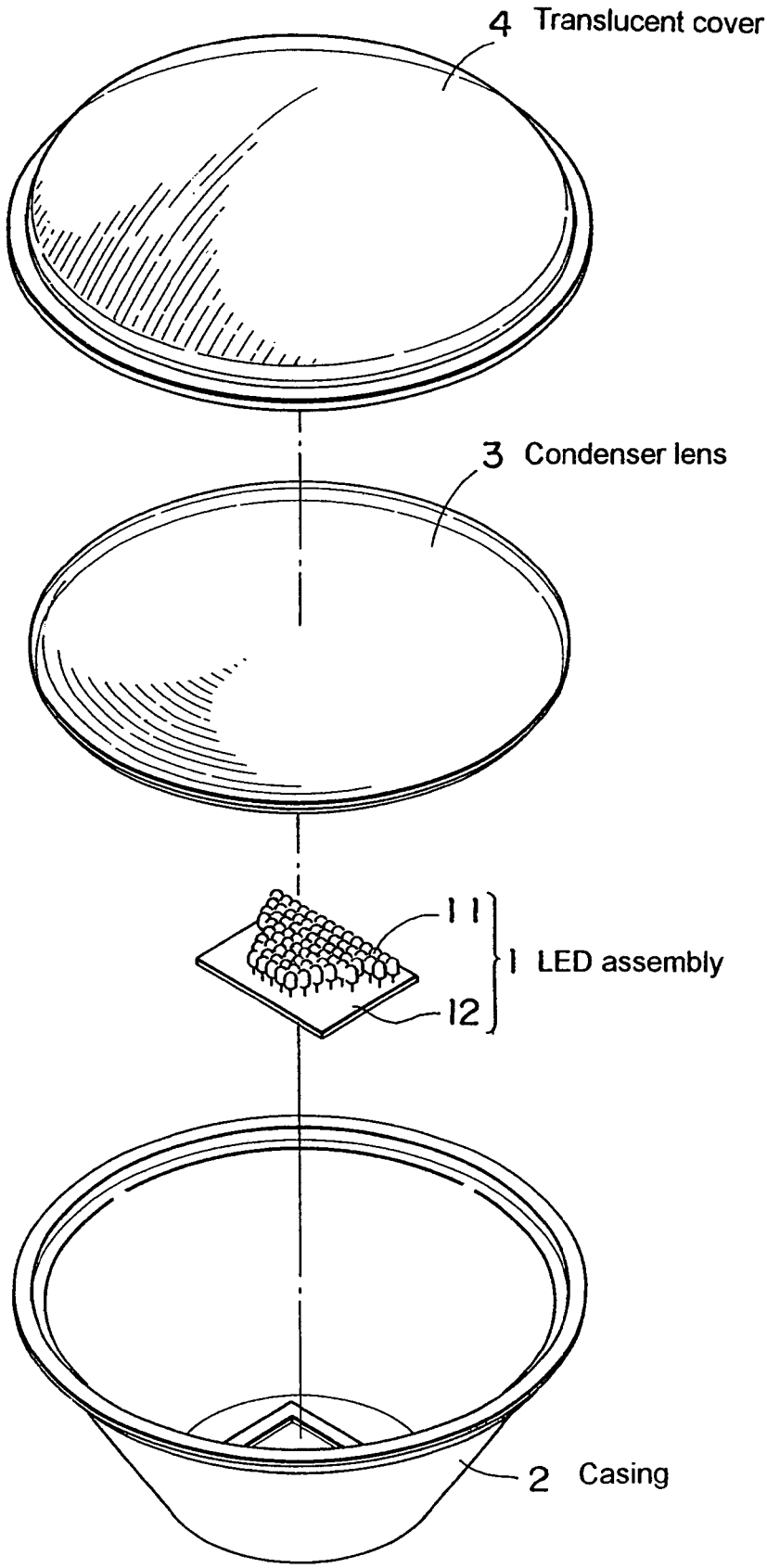
FIG. 1 is an exploded perspective view showing a constitution of an LED indicator lamp according to an embodiment of the present invention.

Now an LED indicator lamp according to an embodiment of the present invention will be described below.

The LED indicator lamp of the present invention is an LED indicator lamp comprising a casing 2 of a truncated conical shape that has a round bottom surface and an opening having a larger diameter than that of the bottom surface, an LED assembly 1 having a plurality of light emitting diodes 11, 11*a* disposed on a substrate 12 placed at a bottom of the casing 2, a condenser lens 3 located at the opening of the casing 2 and a translucent cover 4 located at the opening of the casing 2 so as to cover the condenser lens 3, so that light is emitted in a predetermined luminous intensity distribution pattern.

In more detail, the condenser lens 3 of the LED indicator lamp of the present invention is a Fresnel lens that has a function of a convex lens where light incident on one plane thereof exits from a plane on the other side and is focused, and is placed at the opening of the casing 2 so that a center of the lens substantially corresponds with the opening of the casing 2.

The LED assembly 1 of this embodiment is made by placing the light emitting diodes 11, 11*a* on the substrate 12 in such an arrangement as described below.

Figure 2:
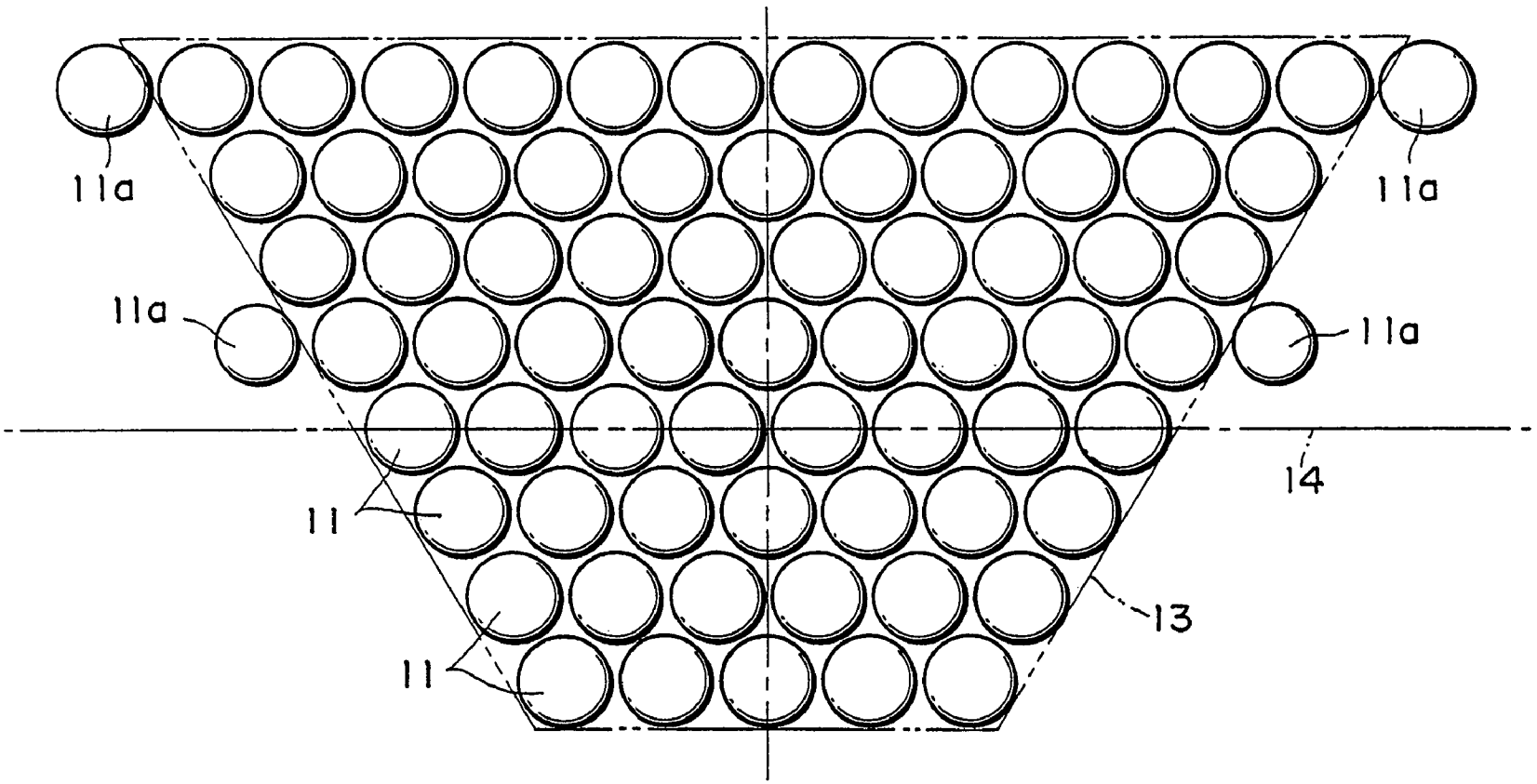
FIG. 2 is a plan view schematically showing an arrangement of light emitting diodes in the LED indicator lamp of the embodiment.

In the LED assembly 1, the plurality of light emitting diodes 11 are disposed on the substrate 12 so as to constitute a fundamental arrangement pattern 13 corresponding to a luminous intensity distribution pattern that satisfies a luminous intensity distribution characteristic required of the LED indicator lamp, as shown in FIG. 2.

Light emitting diode 11*a* is provided to correct the luminous intensity distribution pattern or light intensity distribution generated by the fundamental arrangement pattern 13 so as to form a luminous intensity distribution pattern generated through the condenser lens 3 approximate to a desired luminous intensity distribution pattern or to smooth out unevenness in intensity distribution, and is placed at a predetermined position in the vicinity of the fundamental arrangement pattern 13.

In the LED assembly 1 of this embodiment, the fundamental arrangement pattern 13 is formed so as to comply with a rule that corresponds to the desired luminous intensity distribution pattern.

More specifically, the fundamental arrangement pattern 13 of this embodiment is such that the light emitting diodes 11 are disposed along a plurality of horizontal lines parallel to reference horizontal lines that are perpendicular to the optical axis of the condenser lens 3, while a number of light emitting diodes disposed on each horizontal line increases with respect to each lower horizontal line.

FIG. 2 shows that the number of light emitting diodes disposed on one horizontal line is one more than the number of light emitting diodes disposed on an immediately lower horizontal line. However, the present invention is not limited to this constitution, and any arrangement of the light emitting diodes 11 may be employed as long as a luminous intensity distribution pattern that satisfies a luminous intensity distribution characteristic required of the LED indicator lamp can be achieved.

Also according to the present invention, the light emitting diodes may be arranged according to such a simple rule as, for example, the number of light emitting diodes disposed on a horizontal line located above the optical axis is larger than the largest of numbers of light emitting diodes disposed on horizontal lines located below the optical axis, as long as a luminous intensity distribution characteristic required of the LED indicator lamp can be achieved.

The LED assembly 1 having the constitution described above is placed at the bottom of the casing 2 so that a particular point (datum point) of the fundamental arrangement pattern is located on an axis of the casing 2 that has the truncated conical shape, namely the optical axis of the condenser lens 3. With this configuration, the luminous intensity distribution pattern that satisfies the luminous intensity distribution characteristic required of the LED indicator lamp and the luminous intensity distribution pattern formed by the arrangement of the light emitting diodes and the condenser lens 3 can be made substantially identical to each other.

When the arrangement pattern of the light emitting diodes is moved in a direction perpendicular to the optical axis of the condenser lens 3, a luminous intensity distribution pattern generated by light emitted through the condenser lens 3 changes as a position of the light emitting diodes changes. Therefore, it is necessary to align the condenser lens 3 and the LED assembly 1 so that the luminous intensity distribution pattern formed by the arrangement of the light emitting diodes and the condenser lens 3 agrees with the luminous intensity distribution pattern that satisfies the luminous intensity distribution characteristic required of the LED indicator lamp.

The luminous intensity distribution pattern formed by the arrangement of the light emitting diodes and the condenser lens 3 can be made to agree with the desired luminous intensity distribution pattern, by moving the arrangement pattern of the light emitting diodes in the direction perpendicular to the optical axis of the condenser lens 3, regardless of where the LED assembly 1 is located, either at the focal point of the condenser lens 3, in the vicinity of the focal point, before the focal point or behind the focal point.

That is, the LED indicator lamp of this embodiment achieves the desired luminous intensity distribution pattern by setting the arrangement pattern of the light emitting diodes in the LED assembly 1 in correspondence to the luminous intensity distribution pattern that satisfies the luminous intensity distribution characteristic required of the LED indicator lamp, and setting relative positions of the condenser lens 3 and the LED assembly 1 (determining a distance between the condenser lens 3 and the LED assembly 1, and a position of the LED assembly 1 in a plane perpendicular to the optical axis of the condenser lens 3) so that the luminous intensity distribution pattern formed by the arrangement of the light emitting diodes and the condenser lens 3 agrees with the luminous intensity distribution pattern that satisfies the luminous intensity distribution characteristic required of the LED indicator lamp.

Since the distance between the condenser lens 3 and the LED assembly 1 is determined depending on the position of the LED assembly 1 (arrangement pattern of the light emitting diodes) relative to the optical axis of the condenser lens 3, location of the LED assembly 1 is not limited to a particular position. However, it is preferable to locate the LED assembly 1 at the focal point of the condenser lens 3, in the vicinity of the focal point, or behind the focal point for the reason described below.

In the LED indicator lamp of this embodiment, the translucent cover 4 is provided in order to eliminate unevenness in light intensity that varies with a small period in space in a luminous intensity distribution pattern generated by light emitted through the condenser lens 3. The unevenness in the light intensity that varies with the small period in space refers to variations in the light intensity with the small period caused by a periodic arrangement of the light emitting diodes. This variation causes individual light emitting diodes to be recognized as dots when light emitted through the condenser lens 3 is directly observed, thus resulting in deterioration in perception.

Figure 3A:
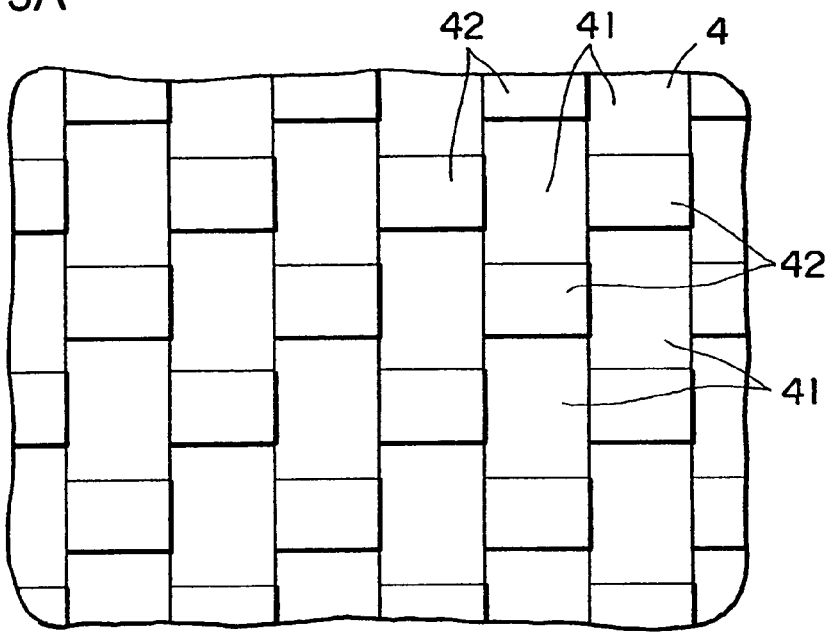
FIG. 3A is a plan view showing an inner surface of a lens pattern of a translucent cover according to the embodiment.
Figure 3B:
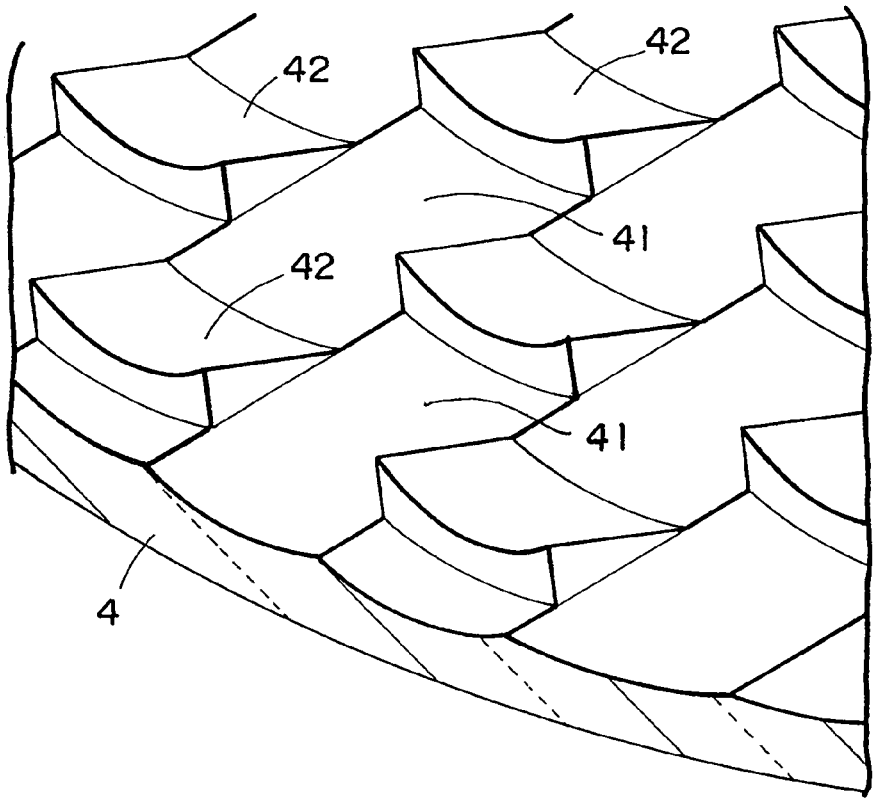
FIG. 3B is a perspective view showing an inner surface of a lens pattern of a translucent cover according to the embodiment.

In the LED indicator lamp of this embodiment, the translucent cover 4 has such a lens pattern as a plurality of lenses 41, 42, shown in FIG. 3, which are periodically arranged on an inner surface of the translucent cover 4, in order to eliminate unevenness in light intensity that varies with a small period in space in a luminous intensity distribution pattern of light emitted through the condenser lens 3.

More specifically, each lens 41 has a concave surface constituted from a part of an inner surface of a cylinder so that incident light is diffused in a horizontal plane, while each lens 42 has a concave surface which is formed to incline from a vertical direction, so as to deflect incident light downwardly.

Variation in light intensity with a small period is eliminated by alternately arranging the lenses 41, 42 of different characteristics.

(Principle of Forming a Luminous Intensity Distribution Pattern in the Embodiment)

Now a principle of forming the luminous intensity distribution pattern in this embodiment will be described in more detail below with reference to FIG. 4 through FIG. 8.

FIG. 4 through FIG. 8 are perspective views schematically showing a luminous intensity distribution pattern corresponding to an arrangement pattern of the light emitting diodes. The light emitting diodes 11 are disposed in a horizontal direction on a plane (hereinafter referred to as emission plane) that includes a focal point 3*f* located behind the condenser lens 3 and is perpendicular to optical axis 3*a*.

Figure 4:
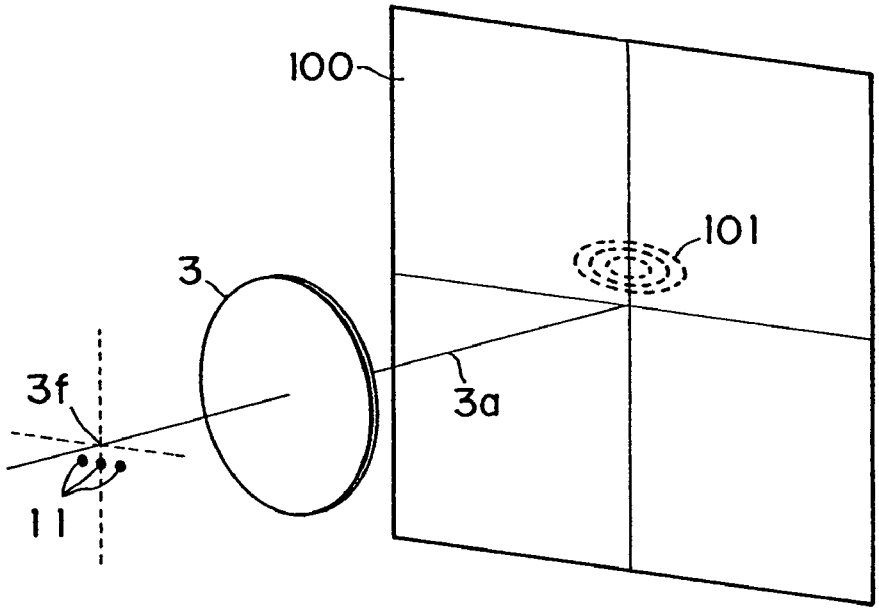
FIG. 4 through FIG. 8 schematically show luminous intensity distribution patterns corresponding to arrangements of light emitting diodes, respectively.

FIG. 4 schematically shows a luminous intensity distribution pattern formed by light rays emitted by three light emitting diodes that are arranged on a horizontal line located below the focal point 3*f* of the condenser lens 3 in the emission plane, illustrated by way of an image 101 formed on an imaginary image plane 100 located in front of the condenser lens 3.

As shown in FIG. 4, the image 101, formed by light emitted by the light emitting diodes that are located below the focal point 3*f* of the condenser lens 3 in the emission plane, is located above the optical axis 3*a* in the image plane 100. When the three light emitting diodes are moved downwardly in the emission plane, the image 101 moves upwardly in the image plane 100.

Figure 5:
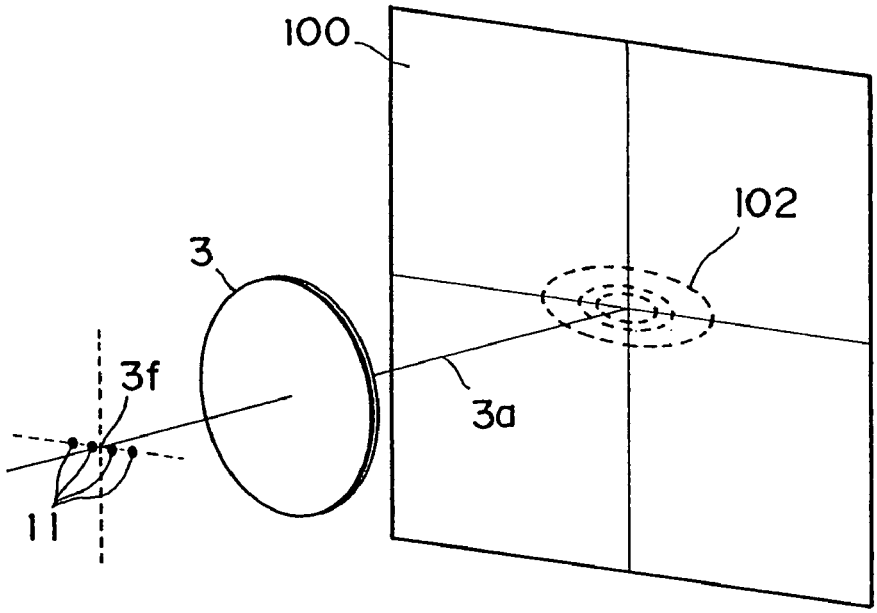

FIG. 5 schematically shows a luminous intensity distribution pattern formed by light rays emitted by four light emitting diodes that are arranged on a horizontal line including the focal point 3*f* of the condenser lens 3 in the emission plane, illustrated by way of an image 102 formed on the image plane 100.

As shown in FIG. 5, the image 102, formed by light emitted by the light emitting diodes that are located on the horizontal line that includes the focal point 3*f* in the emission plane, is observed as an image spreading vertically and horizontally around an intersection of the image plane 100 and the optical axis 3*a* in the image plane 100.

Figure 6:
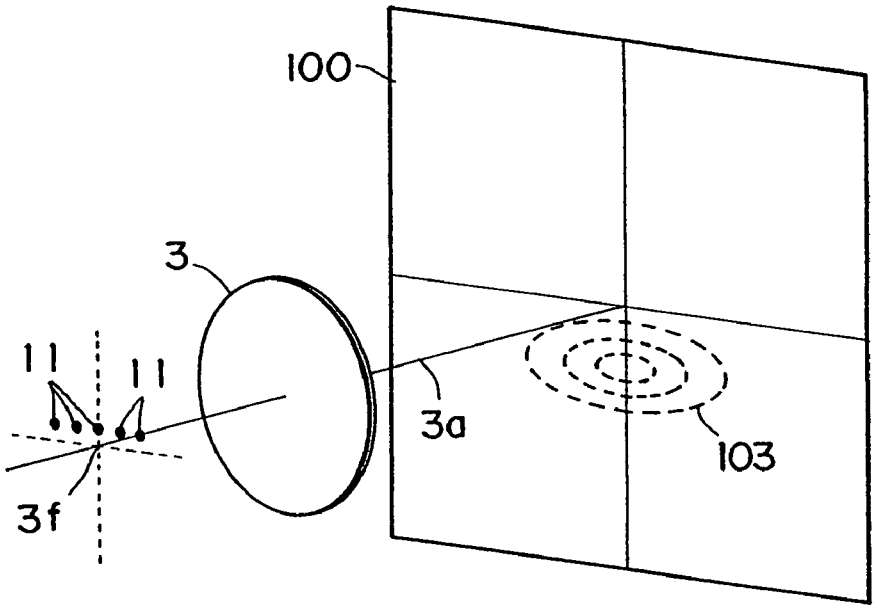

FIG. 6 schematically shows a luminous intensity distribution pattern formed by light rays emitted by five light emitting diodes that are arranged on a horizontal line located above the focal point 3*f* in the emission plane, illustrated by way of an image 103 formed on the imaginary image plane 100 located in front of the condenser lens 3.

As shown in FIG. 6, the image 103, formed by light emitted by the light emitting diodes that are located above the focal point 3*f* of the condenser lens 3 in the emission plane, is located below the optical axis 3*a* in the image plane 100. When the five light emitting diodes are moved upwardly in the emission plane, the image 103 moves downwardly in the image plane 100.

Figure 7:
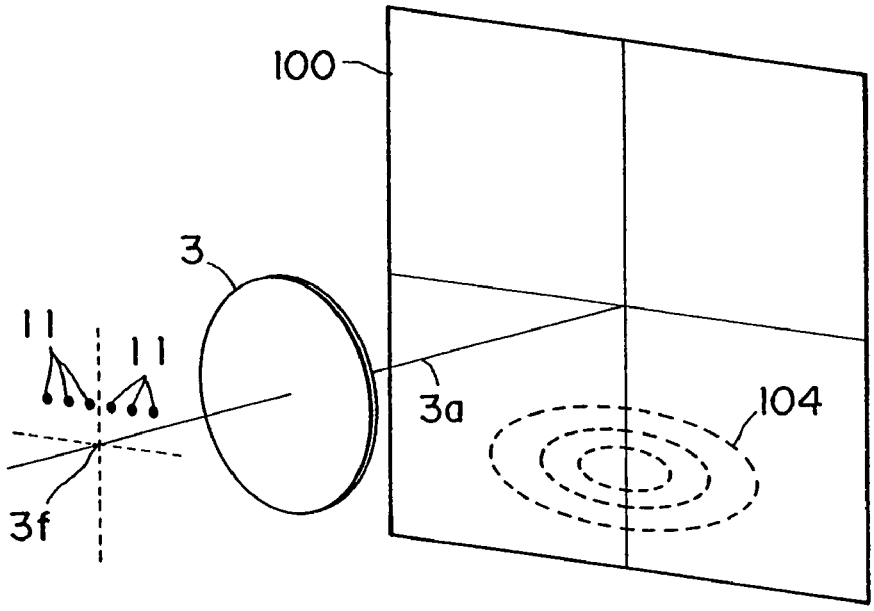

FIG. 7 schematically shows a luminous intensity distribution pattern formed by light rays emitted by six light emitting diodes that are arranged on a horizontal line located above the focal point 3*f*, higher than in the case of FIG. 6, in the emission plane, illustrated by way of an image 104 formed on the imaginary image plane 100.

As shown in FIG. 7, when the light emitting diodes are placed higher than in the case of FIG. 6 in the emission plane, the image 104 is formed lower than image 103, in the case of FIG. 6, in the image plane 100.

Figure 8:
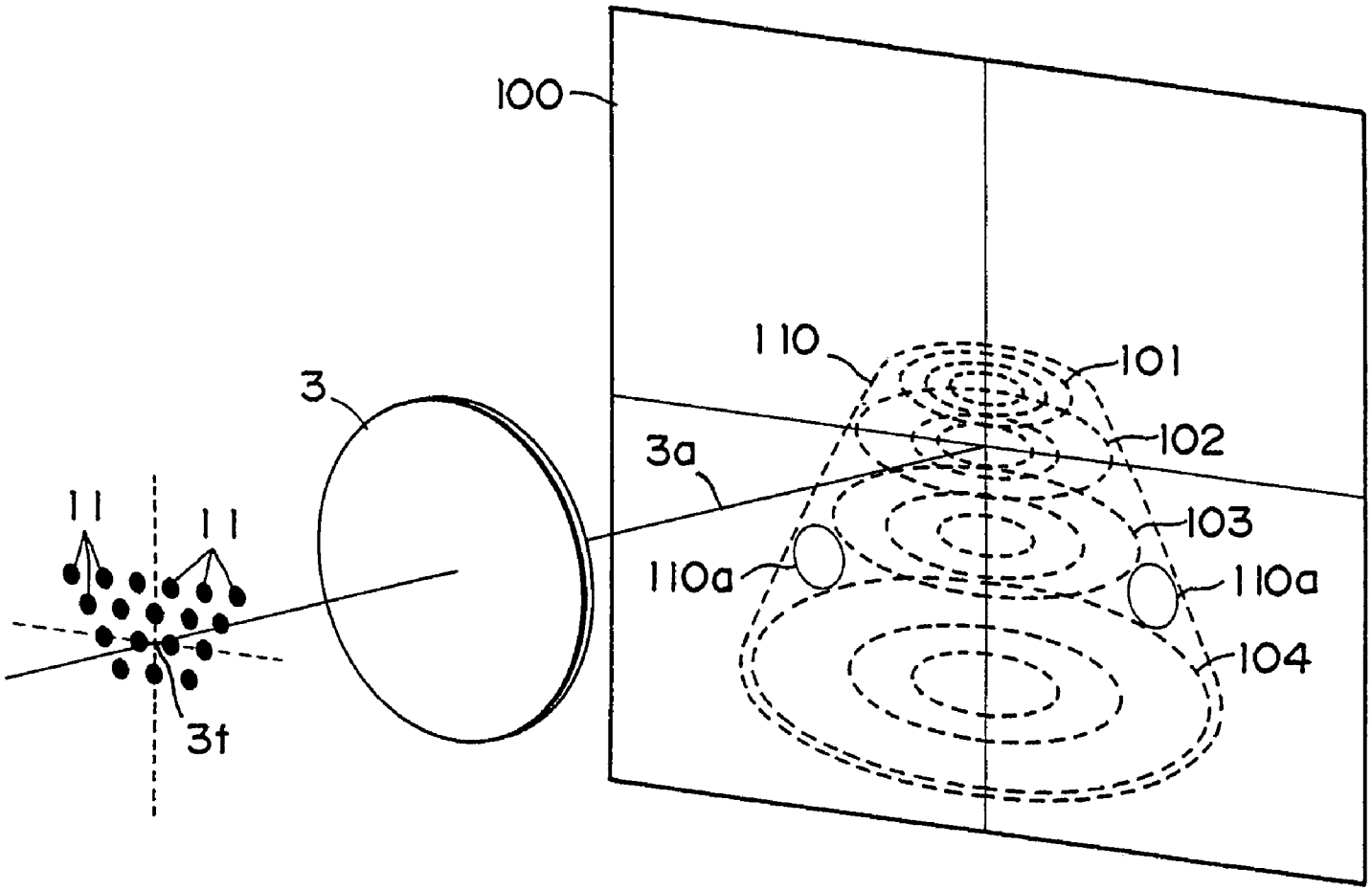

FIG. 8 shows an image 110 formed on the image plane 100 when the light emitting diodes of the arrangements shown in FIG. 4 through FIG. 7 are all arranged in the emission plane.

In this case, the image 110 is formed by overlapping of images 101, 102, 103 and 104 formed by the light emitting diodes arranged along each horizontal line as schematically shown in FIG. 8.

As shown in FIG. 8, when the light emitting diodes are disposed in such an arrangement wherein the number of light emitting diodes disposed along a horizontal line increases for each higher horizontal line in the emission plane, and light rays emitted by the light emitting diodes arranged as described above are output through the condenser lens 3, light spreads in a horizontal direction more widely in an upper field than light spreads in the horizontal direction in a lower field.

When the arrangement pattern of the light emitting diodes 11 shown in FIG. 8 is moved upwardly as a whole, the image 110 moves downwardly in the image plane 100. When the arrangement pattern is moved downwardly as a whole, the image 110 moves upwardly in the image plane 100.

In other words, light can be deflected downwardly by moving the arrangement pattern upwardly in the emission plane, and light can be deflected upwardly by moving the arrangement pattern downwardly in the emission plane.

Similarly, light can be deflected to the left by moving the arrangement pattern to the right in the emission plane, and light can be deflected to the right by moving the arrangement pattern to the left in the emission plane.

Thus, since a luminous intensity distribution characteristic is achieved by overlapping of luminous intensity distribution characteristics of the light emitting diodes arranged in individual lines, an overall luminous intensity distribution characteristic may include a portion of lower light intensity around a luminous intensity distribution pattern indicated with numeral 110*a* in FIG. 8.

In such a case, unevenness in light intensity can be smoothed by placing an additional light emitting diode at a position in the emission plane corresponding to the portion 110*a*. Light emitting diode 11*a* shown in FIG. 2 is provided for a purpose of achieving a luminous intensity distribution pattern similar to a desired luminous intensity distribution pattern by smoothing unevenness in light intensity.

Figure 9:
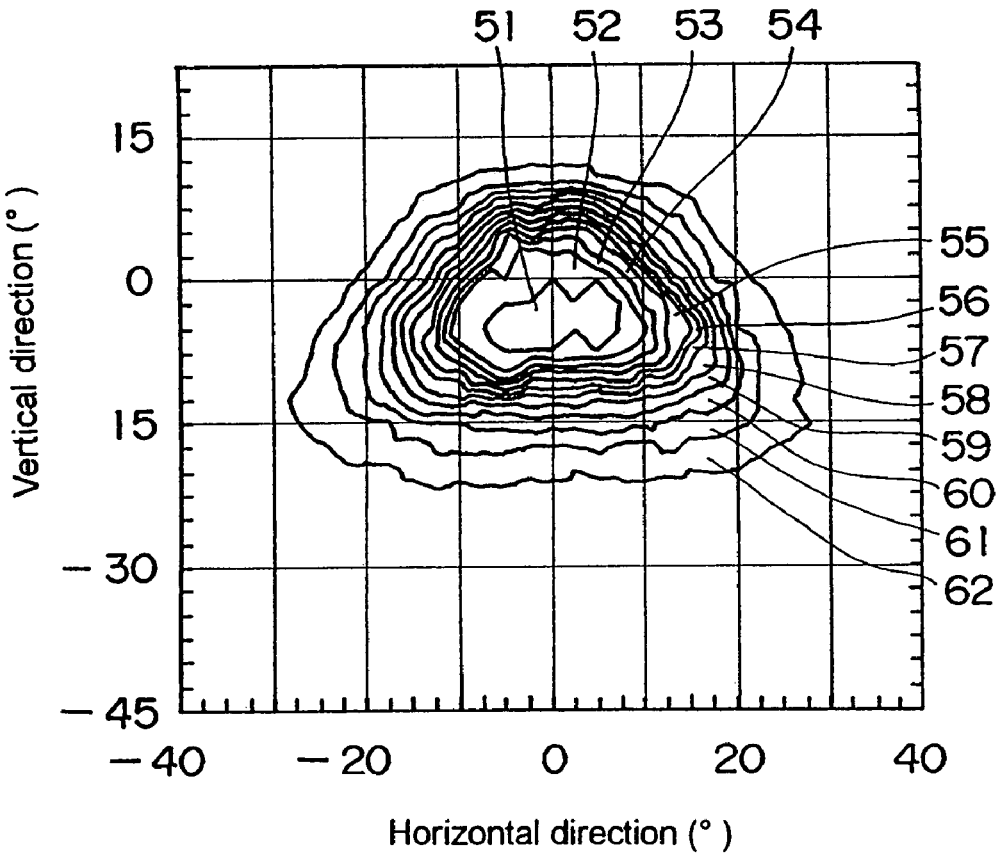
FIG. 9 is a graph showing an example of a luminous intensity distribution characteristic according to the embodiment.
Figure 10:
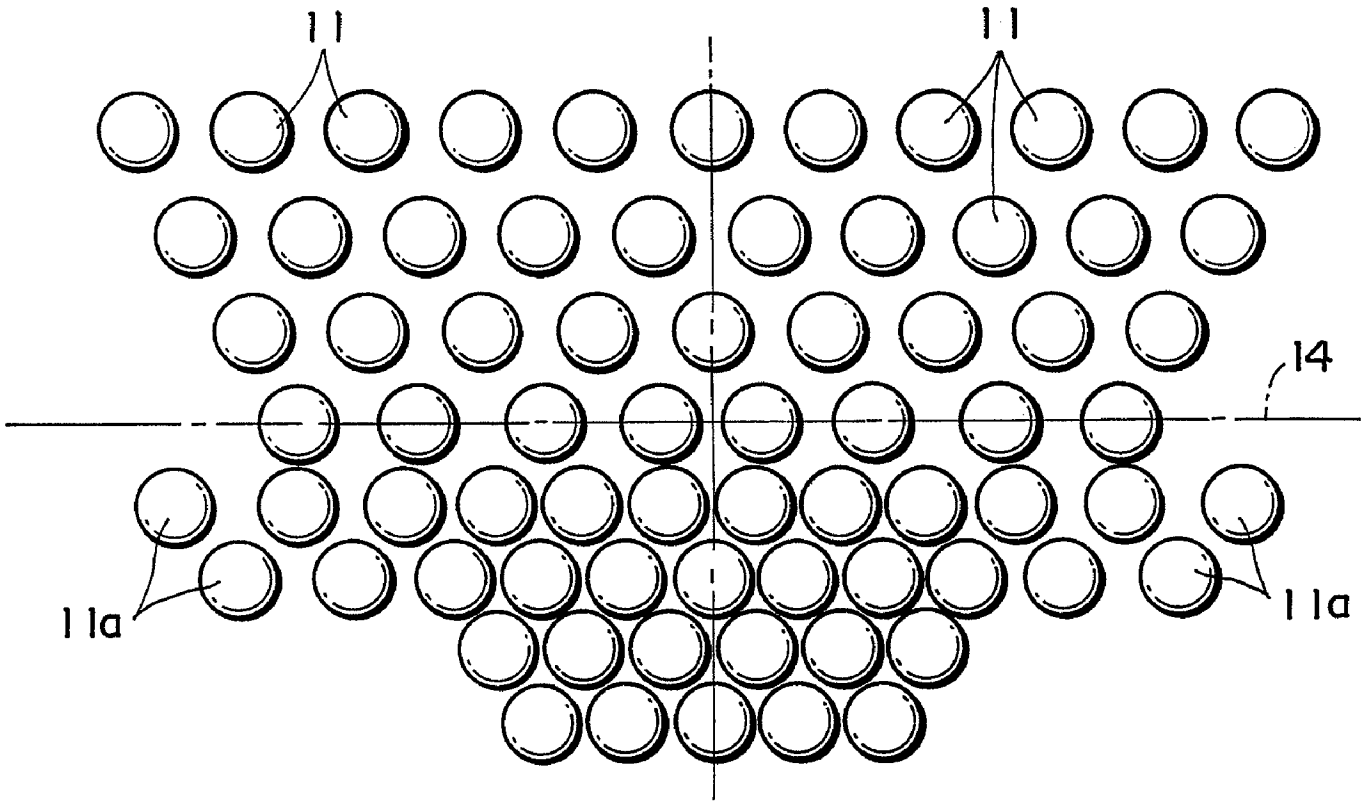
FIG. 10 is a plan view showing an arrangement of light emitting diodes in an LED indicator lamp of a variation of the embodiment of the present invention.

FIG. 9 is a graph of light intensity distribution in an image plane for an example of a luminous intensity distribution characteristic in a case of light emitting diodes being arranged as shown in FIG. 2.

Data shown in FIG. 9 were obtained by measurement using a condenser lens 300 nm in diameter having a focal length of 120 mm, and light emitting diodes arranged in a plane that includes the focal point of the condenser lens 3 and is perpendicular to the optical axis of the condenser lens.

Luminous intensities in regions shown in FIG. 9 are as follows:

Region enclosed by line 51: 600 candelas or higher

Region enclosed by line 51 and line 52: from 550 to 600 candelas

Region enclosed by line 52 and line 53: from 500 to 550 candelas

Region enclosed by line 53 and line 54: from 450 to 500 candelas

Region enclosed by line 54 and line 55: from 400 to 450 candelas

Region enclosed by line 55 and line 56: from 350 to 400 candelas

Region enclosed by line 56 and line 57: from 300 to 350 candelas

Region enclosed by line 57 and line 58: from 250 to 300 candelas

Region enclosed by line 58 and line 59: from 200 to 250 candelas

Region enclosed by line 59 and line 60: from 150 to 200 candelas

Region enclosed by line 60 and line 61: from 100 to 150 candelas

Region enclosed by line 61 and line 62: from 50 to 100 candelas.

When it is desired to make light intensity higher in a particular direction, density of light emitting diodes in a portion of the arrangement pattern corresponding to the direction may be increased as will be described in a variation of the embodiment.

As described above, the LED indicator lamp according to the embodiment of the present invention can achieve a desired luminous intensity distribution pattern with a simple constitution, by employing the condenser lens 3 and arranging the light emitting diodes in an arrangement pattern that corresponds to the desired luminous intensity distribution pattern.

Also, the LED indicator lamp according to the embodiment of the present invention allows a change of direction of light emission (direction in which light intensity is highest) while maintaining a basic luminous intensity distribution pattern, by changing relative positions of the substrate, whereon the light emitting diodes are arranged in the predetermined arrangement pattern, and the condenser lens 3.

Variation

An LED indicator lamp of a variation of the present invention is constituted similarly to the LED indicator lamp of the embodiment except for changing an arrangement pattern of the light emitting diodes 11, 11*a* on the substrate 12.

In the LED indicator lamp of this variation, density of the light emitting diodes 11 disposed below a horizontal 14, that crosses the optical axis of the condenser lens 3 at a right angle, is made higher than density of the light emitting diodes 11 disposed below the horizontal 14.

This constitution makes it possible to increase light intensity in a particular portion that corresponds to a portion of high density in the arrangement pattern, thereby to achieve a desired intensity distribution in a luminous intensity distribution pattern in correspondence to density of the arrangement pattern.

Also according to the present invention, spaces between adjacent light emitting diodes can be changed for the light emitting diodes disposed in the horizontal direction as shown in FIG. 11.

This makes it possible to change a light intensity distribution from a right to left of center in correspondence to the spaces between adjacent light emitting diodes.

Figure 11A:
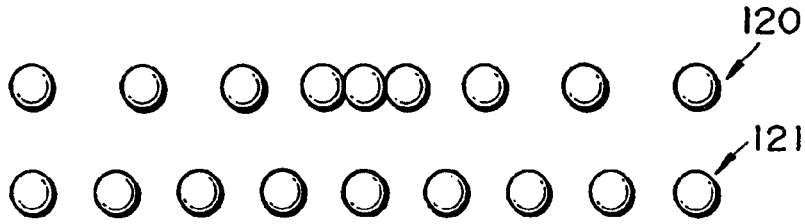
FIG. 11A is a plan view showing an arrangement of light emitting diodes in a variation of the embodiment of the present invention, different from that of FIG. 10.
Figure 11B:
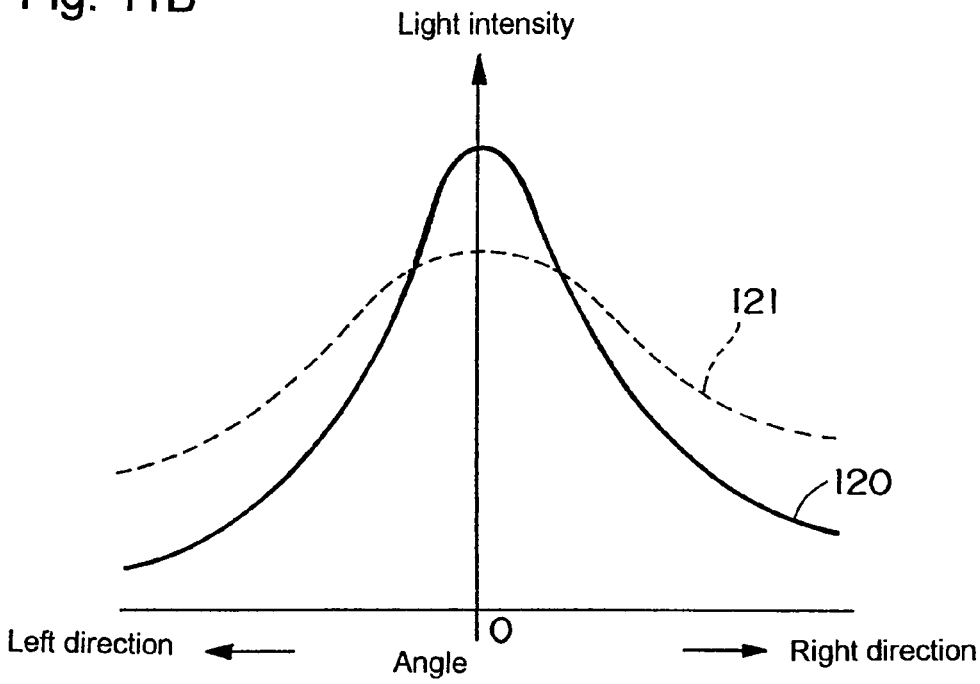
FIG. 11B is a graph schematically showing an intensity distribution as a function of angle in a case of arranging light emitting diodes as shown in FIG. 11A.

FIG. 11B is a graph showing the situation described above. In FIG. 11B, light intensity distribution from right to left of center is indicated schematically by solid line 120 when a space between light emitting diodes located away from the center is made larger than a space between light emitting diodes located near the center as shown in FIG. 11A.

In FIG. 11B, light intensity distribution from right to left is indicated schematically by dashed line 121 when light emitting diodes are disposed with uniform density on the horizontal line for a purpose of comparison.

As will be clear from FIG. 11B, it is made possible to change a light intensity distribution from right to left of center in correspondence to spaces between adjacent light emitting diodes.

In the example shown in FIG. 11A, spaces between adjacent light emitting diodes disposed in a horizontal direction are changed. However, the present invention is not limited to this constitution and spaces between adjacent light emitting diodes disposed in a vertical direction may also be changed.

This makes it possible to change a light intensity distribution in the vertical direction around the center in correspondence to the spaces between adjacent light emitting diodes.

As will be made clear from the above description of the embodiment and the variation, the LED indicator lamp of the present invention achieves a desired luminous intensity distribution pattern by employing the condenser lens 3, an arrangement pattern of a plurality of light emitting diodes and relative positions of the arrangement pattern and the condenser lens 3. Therefore, desired luminous intensity distribution patterns can be easily achieved to meet various requirements, by changing density of the light emitting diodes in the arrangement pattern depending on position, changing spaces between adjacent light emitting diodes in a horizontal direction or spaces between adjacent light emitting diodes in a vertical direction, in accordance with a desired luminous intensity distribution pattern to be achieved with the LED indicator lamp.

In the embodiment and the variation, a desired luminous intensity distribution pattern is achieved by virtue of an arrangement of a plurality of light emitting diodes and the condenser lens 3. However, the present invention is not limited to this constitution and the desired luminous intensity distribution pattern may also be formed by providing a lens pattern formed on the translucent cover 4 in addition to the plurality of light emitting diodes and the condenser lens 3.

Also in the embodiment and the variation, the arrangement pattern is constituted by arranging light emitting diodes along horizontal lines in a plane perpendicular to the optical axis of the condenser lens 3, but the present invention is not limited to this constitution.

Figure 12A:
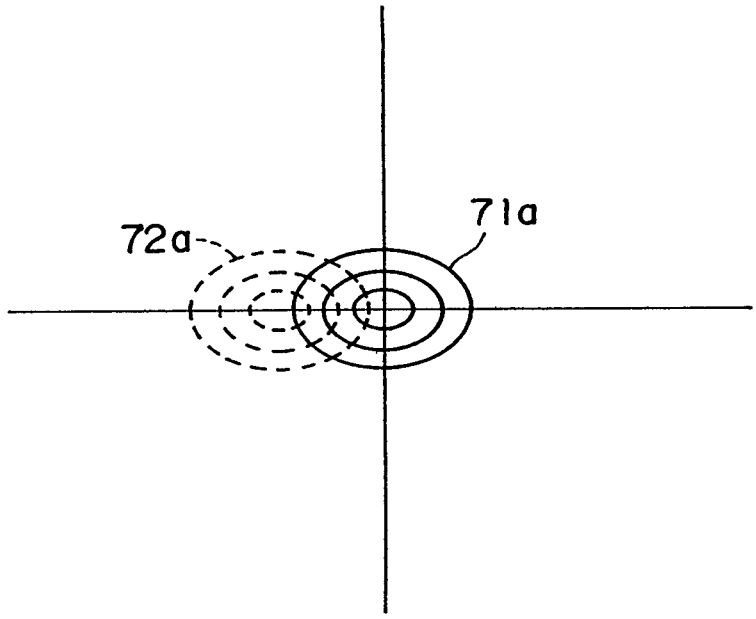
FIG. 12A is a diagram schematically showing an image formed on an imaginary screen when two light emitting diodes are placed on a plane perpendicular to the optical axis of a condenser lens.
Figure 12B:
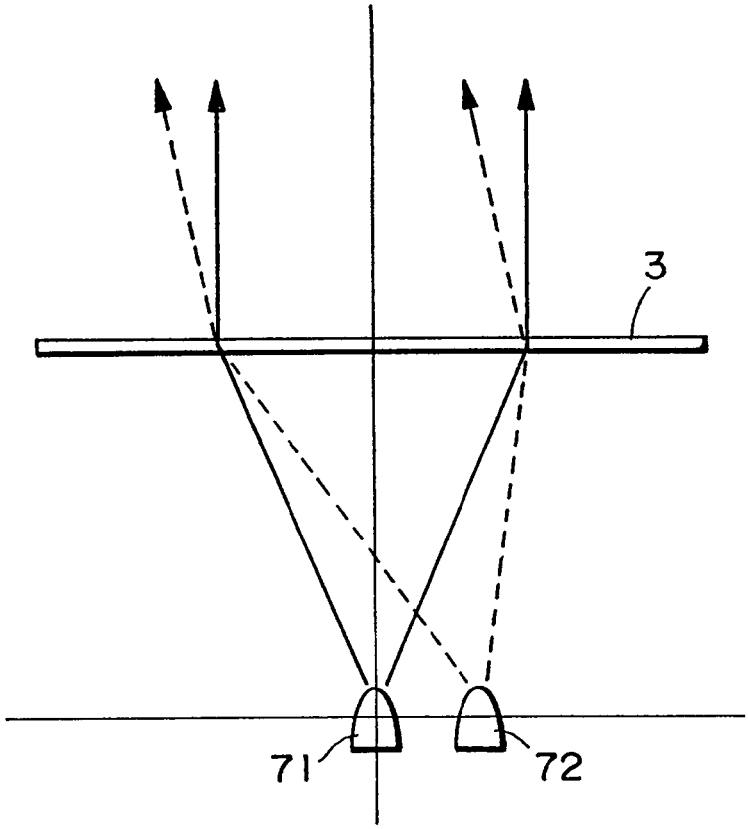
FIG. 12B is a schematic diagram showing a constitution of two light emitting diodes placed on a plane perpendicular to the optical axis of the condenser lens.

Specifically, when light emitting diodes 71, 72 are arranged in a plane perpendicular to the optical axis of the condenser lens 3 (FIG. 12B), images 71*a*, 72*a* are formed on a screen in correspondence to the light emitting diodes 71, 72 (FIG. 12A).

Figure 13A:
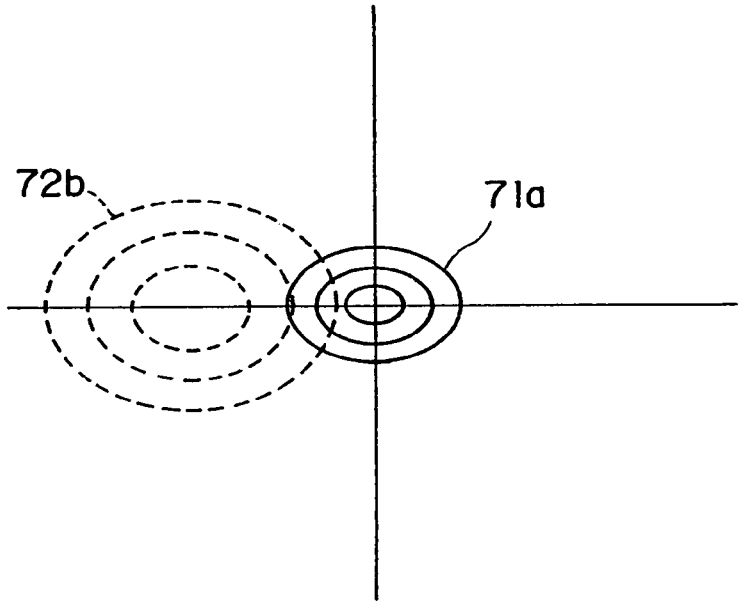
FIG. 13A is a diagram schematically showing an image formed on an imaginary screen when two light emitting diodes are placed on a plane that is inclined relative to the optical axis of the condenser lens.
Figure 13B:
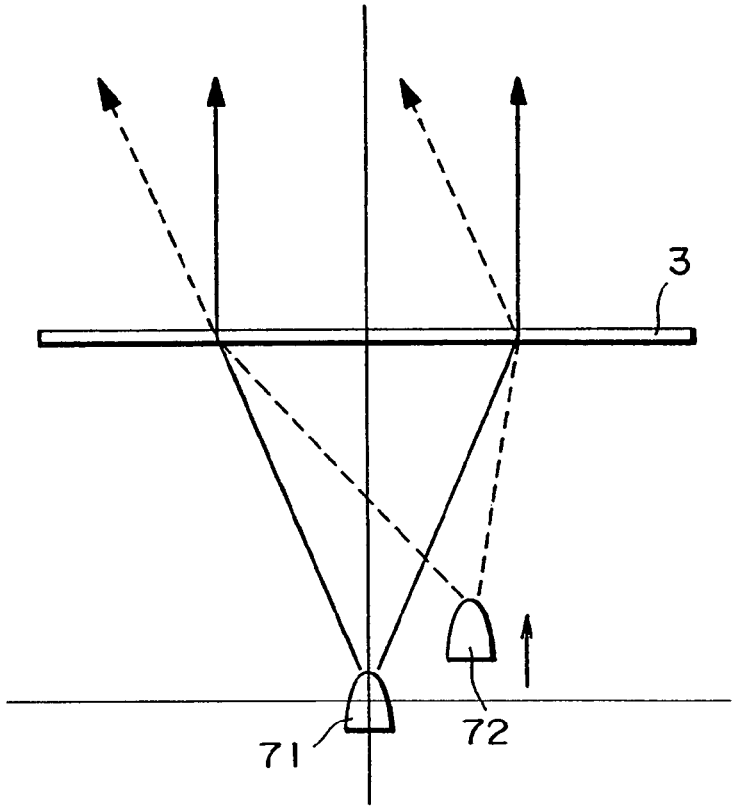
FIG. 13B is a schematic diagram showing a constitution of two light emitting diodes placed on a plane that is inclined relative to the optical axis of the condenser lens.

In case the light emitting diode 72 is located before the plane perpendicular to the optical axis of the condenser lens 3 (the plane where the light emitting diode 71 is placed) as shown in FIG. 13B, in contrast, image 72*b* of the light emitting diode 72 on the screen is spread to be larger than the image 72*a* shown in FIG. 12A, as shown in FIG. 13A.

Figure 14A:
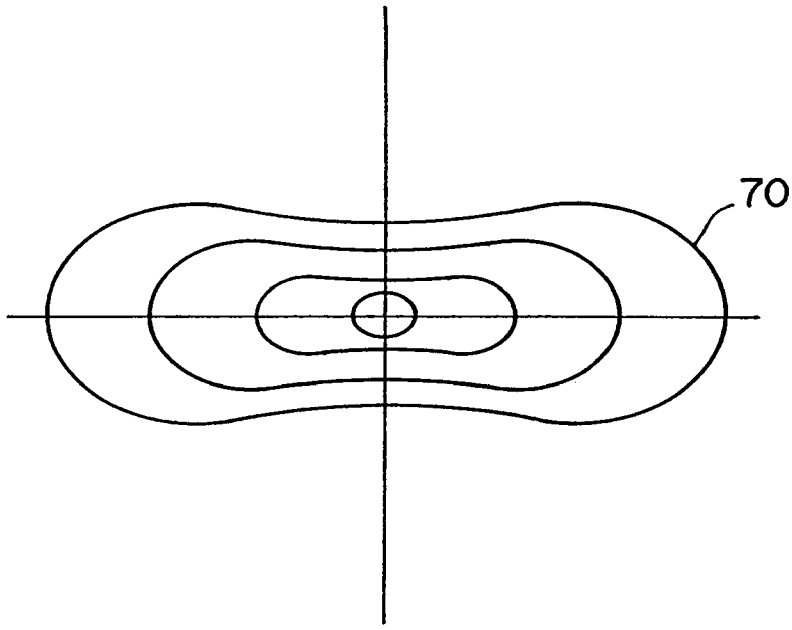
FIG. 14A is a diagram schematically showing an image formed on an imaginary screen when a plurality of light emitting diodes are disposed in a three-dimensional arrangement as shown in FIG. 14B.
Figure 14B:
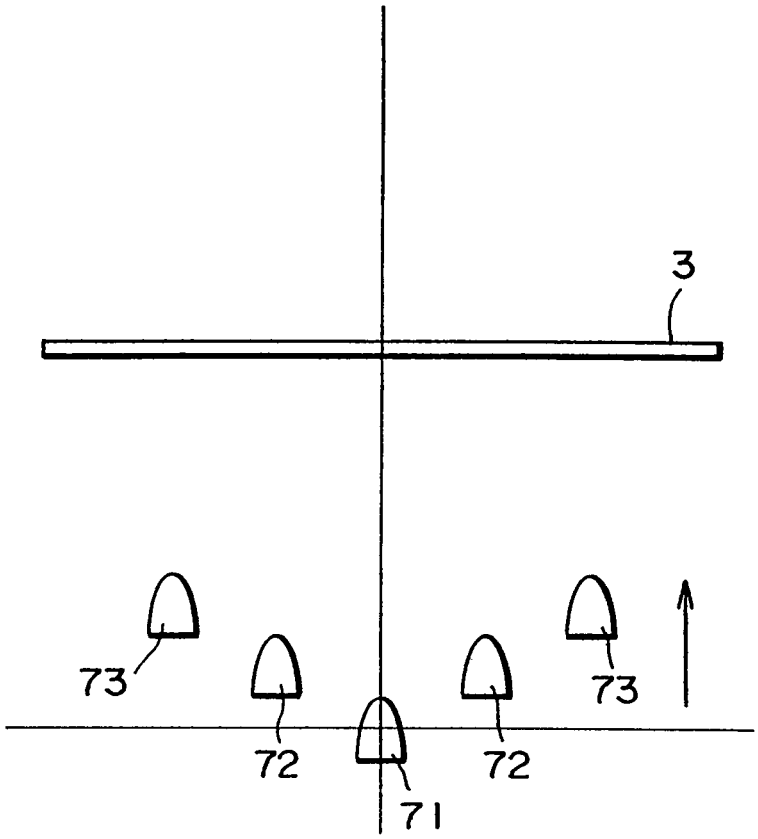
FIG. 14B is a schematic diagram showing an example of a three-dimensional arrangement of a plurality of light emitting diodes.

Therefore, a luminous intensity distribution pattern that is spread in a horizontal direction can be formed as indicated by image 70 shown in FIG. 14A, by placing the light emitting diode 71 at the focal point of the condenser lens 3 and arranging light emitting diodes 72, 73 at advanced positions according to a distance from the light emitting diode 71 to the left and right (FIG. 14B).

Thus, according to the present invention, a luminous intensity distribution pattern that corresponds to an inclination of a plane where light emitting diodes are arranged, or to a three-dimensional arrangement of light emitting diodes, can be achieved by inclining the plane where the light emitting diodes are arranged (so that the plane does not perpendicularly cross the optical axis of the condenser lens 3) or arranging the light emitting diodes in the three-dimensional arrangement.

Three-dimensional arrangement of light emitting diodes may be such wherein the light emitting diodes are disposed on an inner surface of a sphere, the light emitting diodes are disposed on an external surface of a sphere, or the light emitting diodes are disposed on two or more planes that cross each other.

As described in detail above, the present invention is capable of satisfying requirements for wide varieties of luminous intensity distribution characteristics by setting all or part of components in accordance with a desired luminous intensity distribution pattern.

The LED indicator lamp of the present invention is capable of achieving a desired luminous intensity distribution pattern in order to meet wide varieties of requirements, and can therefore be applied to indicating lamps for various applications such as traffic lamps.

What is claimed is:

1. An LED indicator lamp, which has a luminous intensity distribution characteristic, comprising:

light emitting diodes disposed in a three-dimensional arrangement;

a condenser lens, wherein said light emitting diodes are disposed in an arrangement such that the light emitting diodes are placed in at least one portion at intervals that are different from intervals between light emitting diodes in another portion; and a translucent cover placed in front of the condenser lens, the translucent cover having a lens pattern in which a plurality of lenses are disposed in a periodic arrangement; wherein the lenses of the translucent cover include a plurality of lenses having a concave surface for diffusing light in a horizontal plane, and a plurality of lenses having a concave surface and being inclined relative to a vertical direction so as to deflect incident light downwardly.

2. An LED indicator lamp, which has a luminous intensity distribution characteristic, comprising:

a substrate, light emitting diodes disposed on a substrate in a three-dimensional arrangement;

a condenser lens, wherein said light emitting diodes are disposed in an arrangement such that the light emitting diodes located on one portion of the substrate are positioned at intervals that are different from intervals between light emitting diodes located in another portion of the substrate; and a translucent cover placed in front of the condenser lens, the translucent cover having a lens pattern in which a plurality of lenses are disposed in a periodic arrangement, wherein the lenses of the translucent cover include a plurality of lenses having a concave surface for diffusing light in a horizontal plane, and a plurality of lenses having a concave surface and being inclined relative to a vertical direction so as to deflect incident light downwardly.

* * * * *